US005744771A

United States Patent [19]

Ellett

[11] Patent Number: 5,744,771

[45] Date of Patent: Apr. 28, 1998

[54] PRESSURE SWITCH WITH INCREASED DEADBAND

[75] Inventor: James Richard Ellett, Edmonton, Canada

[73] Assignee: Argus Machine Co. Ltd., Edmonton, Canada

[21] Appl. No.: 743,245

[22] Filed: Nov. 5, 1996

[51] Int. Cl.[6] ..... H01H 35/38

[52] U.S. Cl. ..... 200/83 J; 200/835; 403/409.1

[58] Field of Search ..... 254/104; 403/374, 403/409.1; 361/704, 707; 73/861.47, 717, 723, 745; 200/82 R, 82 C, 83 R, 83 J, 83 S, 83 SA; 307/118; 340/626; 92/5 R, 94, 101, 102

[56] References Cited

U.S. PATENT DOCUMENTS

| | | | |
|---|---|---|---|
| 2,748,218 | 5/1956 | Leichsenring | 200/83 |
| 2,767,276 | 10/1956 | Buchanan et al. | 200/82 |
| 3,407,277 | 10/1968 | Chapin | 200/83 |
| 3,449,535 | 6/1969 | Otto et al. | 200/82 |
| 3,619,526 | 11/1971 | Riley | 200/83 J |
| 3,679,325 | 7/1972 | Yost | 417/17 |
| 4,354,769 | 10/1982 | Peter | 403/248 |
| 4,438,305 | 3/1984 | Johnson | 200/83 J |
| 4,503,301 | 3/1985 | Kurtz | 200/83 |
| 4,593,166 | 6/1986 | Hirota et al. | 200/83 |
| 4,900,883 | 2/1990 | Brame et al. | 200/83 |
| 5,122,628 | 6/1992 | McLelland et al. | 200/83 |
| 5,243,158 | 9/1993 | Zimmermann | 200/83 |
| 5,251,099 | 10/1993 | Goss | 361/721 |
| 5,414,593 | 5/1995 | Furlan | 361/784 |
| 5,554,834 | 9/1996 | Ellett | 200/82 |

OTHER PUBLICATIONS

Camrose Electric Controls Ltd., Edmonton, Alberta, Canada, Parts RS73 Pressure Controls, 1 page, 1993.

Barber Industries Ltd., Edmonton, Alberta, Canada, Instructions for Installing and Operating High–Temp Presco–Switches, Type DHTE, Jan. 1992, 1 page.

Barber Industries Ltd., Edmonton, Canada, Pressure Sensing Types, Switch Arrangement Types, 2 pages, date of publication not known but precedes filing date of application.

*Primary Examiner*—Gerald P. Tolin

*Attorney, Agent, or Firm*—Anthony R. Lambert

[57] ABSTRACT

A pressure switch has a housing with an interior bore extending from one end to the other. A rod slidable within the bore and operated by external fluid pressure extends between a piston at one end of the housing and a mechanically operated electrical switch at the other end of the housing. A spring is disposed about the rod between a first stop on the rod and a second stop on the housing. The spring provides resistance against movement of the rod under external pressure. The resistance of the spring to movement is adjusted by a sleeve engaging the spring, with the sleeve threaded into the bore of the housing for movement longitudinally within the housing. A split ring wedged between two other rings resists movement of the rod to longitudinal movement.

8 Claims, 2 Drawing Sheets

PRESSURE SWITCH WITH INCREASED DEADBAND

FIELD OF THE INVENTION

This invention relates to pressure switches.

BACKGROUND AND SUMMARY OF THE INVENTION

In the design of pressure switches, a rod slidable within a housing and movable by changes in external fluid pressure operates a plunger of a mechanically operated electrical switch. Resistance of the rod to movement, and hence the pressure at which the switch trips, is adjusted by a spring within the pressure switch that is biased against movement of the rod due to external fluid pressure. Adjustment of the compression on the spring changes the tripping pressure, which for example may be set at 500 psi. As the pressure reduces, hysteresis in the system arising for example from friction in the switch, hysteresis in the spring and free travel of the mechanically operated switch causes the switch to reset at a lower pressure than the tripping pressure, for example at 450 psi. The difference between the tripping and reset pressure is known as the deadband.

SUMMARY OF THE INVENTION

It is sometimes, however, desirable to have a greater deadband. This invention provides a manner of increasing the deadband of prior art switches. In a switch of the type described in the background of the invention, there is provided according to one aspect of the invention means to increase resistive forces tending to oppose longitudinal movement of the rod within the bore. In a further aspect of the invention, the means to increase resistive forces includes a split ring disposed around the rod and wedged between two whole rings, such that compression of the whole rings causes the split ring to frictionally engage the rod.

Selection of the angle of the wedge angle between the rings allows selection of the deadband. A smaller wedge angle means a greater deadband.

These and other aspects of the invention are described in the detailed description and claims that follow.

BRIEF DESCRIPTION OF THE DRAWINGS

There will now be described preferred embodiments of the invention, with reference to the drawings, by way of illustration, in which like numerals denote like elements and in which.

DETAILED DESCRIPTION OF PREFERRED EMBODIMENTS

Figure 1:
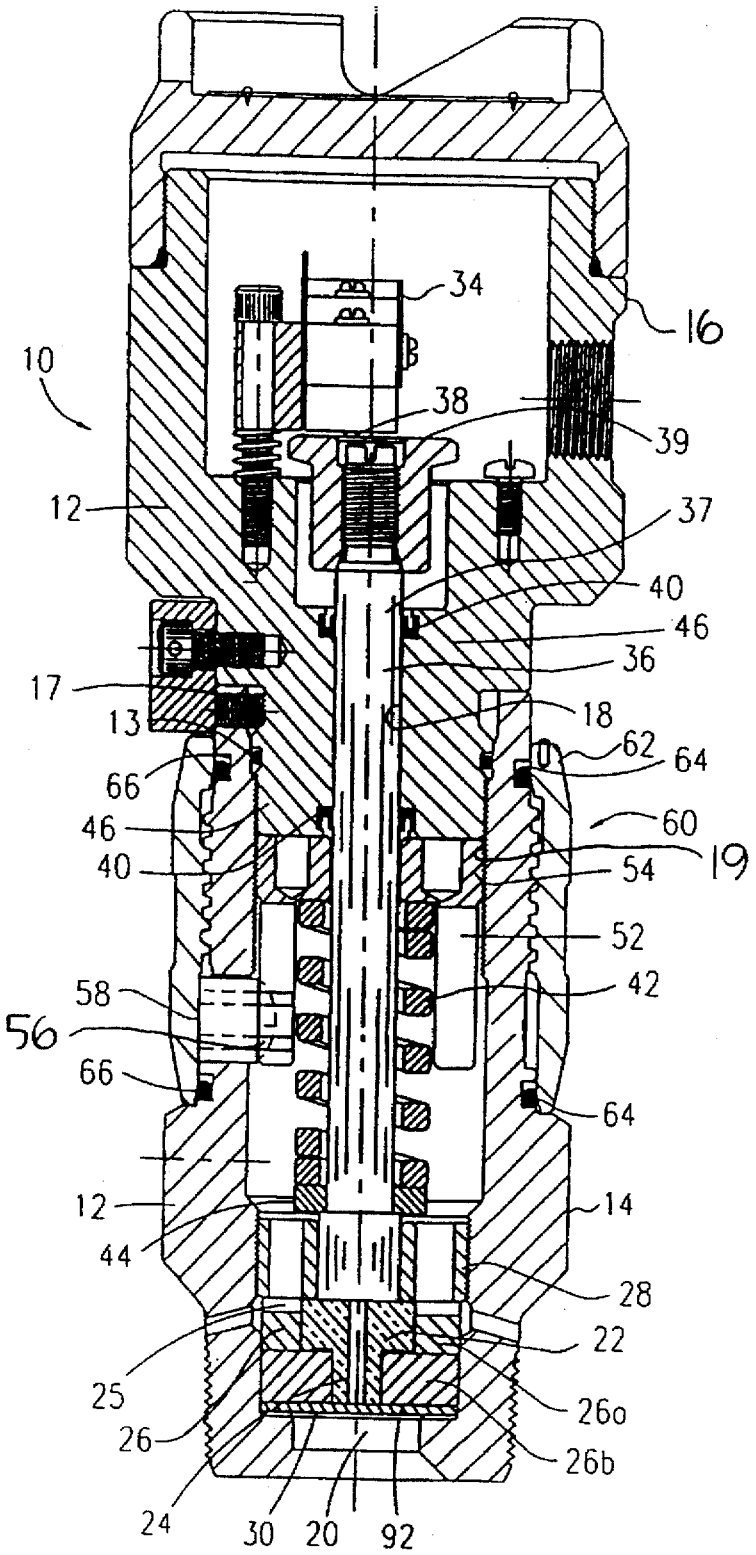
FIG. 1 PRIOR ART
FIG. 1 is a longitudinal section through a prior art pressure switch.

A pressure switch made by Argus Machine CO. Ltd. of Edmonton, Alberta, Canada, is illustrated in FIG. 1, which shows a longitudinal section of a pressure switch 10. The pressure switch 10 is formed of a housing 12 having a first end 14 and a second end 16 threaded together and sealed with seals 13. Set screw 17 locks the first end 14 and second end 16 of the housing together. A bore 18 of variable inner diameter passes through the housing 12 from the first end 14 to the second end 16. In the bore 18 at the first end 14 is a piston 22 that is free to move longitudinally a limited amount within the bore 18. The piston 22 is shown here as including a piston head 24 snugly fitted in piston guide 26 at the first end 14 of the housing 12. The piston guide 26 is formed in two pieces (upper **26*a* and lower 26*b*) and is secured within the housing by a locking nut 28 threaded in the first end of the housing 12. Four laterally extending slots 25 in the top end of upper piece 26*a* of the piston guide 26 allow for draining of fluid. Two of the slots 25 are shown. The other two are at right angles to the section of FIG. 1. End 20 of the bore 18 is sealed by diaphragm 30 that is held firmly within the end 14 by the piston guide 26 and housing 12 and sealed with a gasket 32 or a suitable alternative such as a seal ring. A support disc 92 is interposed between the diaphragm 30 and piston 22 and assists in supporting the diaphragm 30 against collapse from external fluid pressure. Range of movement of the piston is limited by shoulders on the piston guide 26 and by shoulders on the piston 22**.

A mechanically operated electrical switch 34 (microswitch) is disposed at the second end 16 of the housing 12. A rod 36 is mounted slidably within the housing 12 and extends between the piston 22 and the mechanically operated electrical switch 34. By direct contact with the piston 22 and plunger 38 of the switch 34, the rod 36 is operatively connected to both the piston 22 and the switch 34, but this operative connection may be accomplished using intervening devices, with added complexity. The diaphragm 30, piston 22 and rod 36 function as a mechanism to transfer external fluid pressure along rod 36 to the mechanically operated electrical switch 34. The mechanically operated electrical switch is operated by a plunger 38, which abuts against hub 39 threaded onto the end 37 of rod 36. Movement of the rod 36 and hub 39 in the direction from the first end of the housing 12 to the second end depresses the plunger 38 and activates the switch 34. The end 37 of the rod 36 is sealed within the bore 18 by elastomer seals 40.

A spring 42 is disposed about the rod 36 between a first stop 44 on the rod 36 and a second stop 54 forming part of the adjustment sleeve 52. The spring 42 provides resistance against movement of the rod 36 from the first end 14 of the housing 12 to the second end 16 of the housing 12. The degree of resistance of the spring 42 to external fluid pressure on piston 22, hence movement of rod 36, is adjustable by an adjustment sleeve 52 surrounding and thus engaging one end of the spring 42. The sleeve 52 includes a threaded portion 54 threaded into the bore 18 of the housing 12 at threads 19 for movement longitudinally within the housing 12 by rotation of the sleeve 52. Plural radially extending slots 56 are disposed around the sleeve 52 and are shaped to receive an implement, such as a screw driver, used to rotate the sleeve 52. A port 58 or opening in the housing 12 is provided and makes the adjustment sleeve 52 accessible, for example by a screwdriver or other means for operating the adjustment sleeve 52. A cover 60 for the port 58 is provided by a ring 62 disposed around the housing 12 and threaded onto the housing 12 over the port 58.

Figure 2:
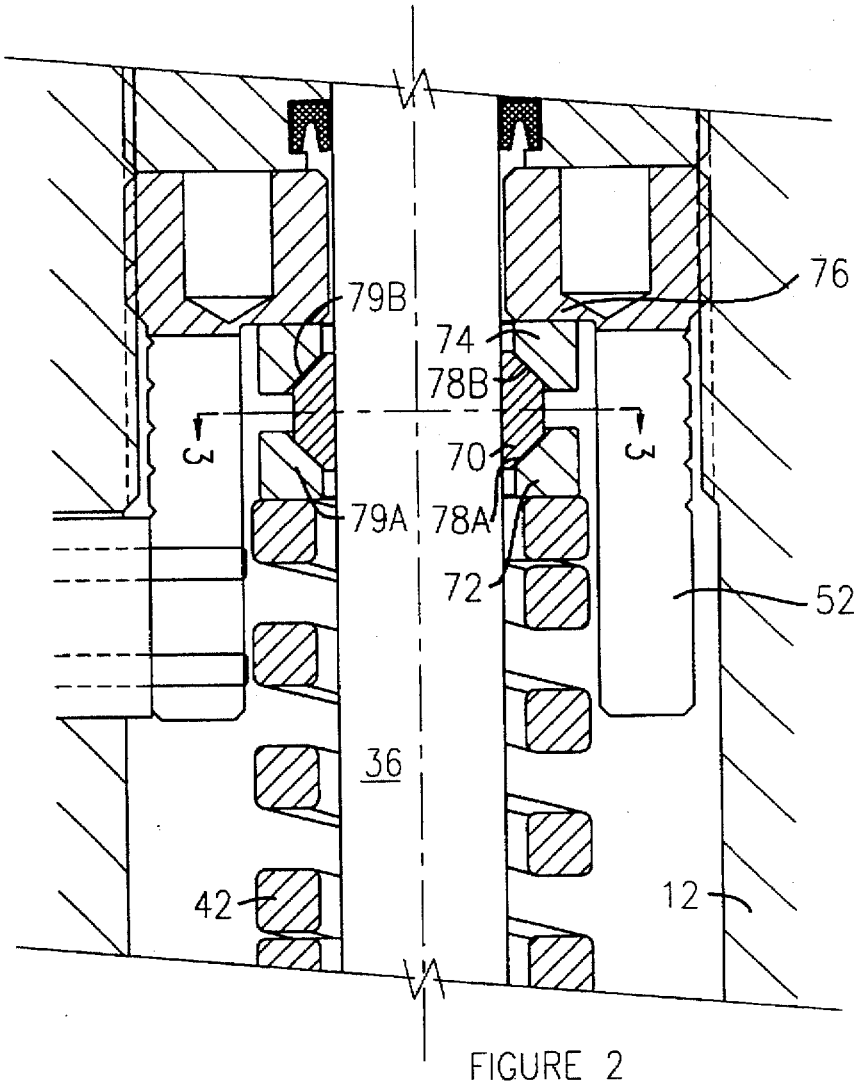
FIG. 2 is a longitudinal section through a pressure switch according to the invention.
Figure 3:
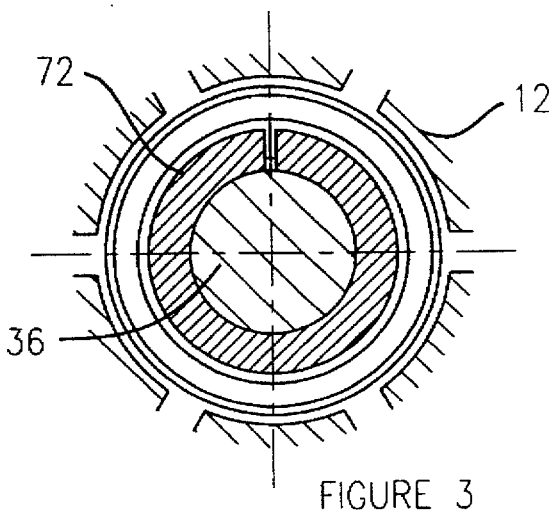
FIG. 3 is a cross-section along the line 3—3 of FIG. 2.

The invention shown in FIGS. 2 and 3 is used on the switch shown in FIG. 1. Except as indicated below, the parts of the pressure switch 10 used in FIGS. 2 and 3 may be the same as shown in FIG. 1 or any other pressure switch having a spring biased rod that actuates a mechanical switch. Spring 42 is disposed within the housing 12 and oriented to resist movement of the rod 36 within the bore 18. Sleeve 52 is encapsulated within the housing 12 and may be rotated to adjust resistance of the rod 36 to movement under external fluid pressure towards the mechanically operated switch 34. To increase resistive forces on the rod 36, which prevents tripping of the switch 34 until higher pressures but also increases the deadband of the switch, a split ring 70 is disposed around the rod 36 and sandwiched between two rings 72 and 74. The ring set formed of rings 70, 72 and 74 is prevented from longitudinal movement towards the switch 34 by a shoulder 76 on the sleeve 52, and the spring 42 acts against the ring set.

The ring set, under pressure of the spring 42, acts to increase resistive forces tending to oppose movement of the rod 36 within the bore 18 towards and away from the mechanically operated switch 34. The split ring 70 has opposed bevelled edges 78A and 78B that taper radially inwardly away from the center of the split ring. The rings 72 and 74 have corresponding bevelled edges 79A and 79B that are complementary to the edges 78A and 78B. Pressure from the spring 42 urges the rings 72 and 74 together so that they tend to ride up onto the split ring 70. As the rings 72 and 74 are whole, they cannot diverge radially outward, and thus the split ring 70 is forced inward by the rings 72 and 74 to contract about the rod 36. Hence longitudinal forces on the rings 72 and 74 are converted to radial forces on the split ring 70. The split ring 70 thus tends to grip the rod 36 and move with it. The split ring 70 is stopped from longitudinal movement towards the switch 34 by the shoulder 76 on adjustment sleeve 52, and away from the switch by the spring 42. The drag on the rod 36 caused by the split ring 70 gripping the rod 36 thus increases resistance of the rod 36 to movement longitudinally within the bore 18.

As a result, the use of the ring set illustrated in FIGS. 2 and 3 serves to increase the deadband of the switch. Increasing the angle of the bevelled edges (in relation to an axis parallel to the rod) tends to decrease the deadband. For example an angle of 22° for the bevelled edges 78A, 78B, 79A, 79B in an exemplary embodiment has produced a deadband of 200 psi, while an angle of 300 has produced a deadband of 150 psi and an angle of 450 has produced a deadband of 100 psi. Since the use of the rings 70–74 tends to increase the tripping pressure, for a given tripping pressure, the compression on the spring 42 should be adjusted.

A person skilled in the art could make immaterial modifications to the invention described and claimed in this patent without departing from the essence of the invention.

The embodiments of the invention in which an exclusive property or privilege is claimed are defined as follows:

1. A pressure switch comprising:

a housing with an interior bore;

a rod slidable over a limited range within the bore under external fluid pressure;

a mechanically operated electrical switch operatively connected to the rod;

a spring disposed within the housing and oriented to resist movement of the rod within the bore;

adjustment means encapsulated within the housing to adjust resistance of the rod to movement under the external fluid pressure; and means, responsive to spring pressure, to increase frictional forces on the rod tending to oppose longitudinal movement of the rod within the bore.

2. The pressure switch of claim 1 in which the means to increase resistance includes:

a split ring disposed around the rod; and means to force the split ring radially inward upon movement of the rod under external pressure acting on the pressure switch.

3. The pressure switch of claim 2 in which the means to force the ring radially inward includes:

the split ring having a central portion and at least a bevelled first edge, the bevelled first edge tapering radially inward in a longitudinal direction away from the central portion; and a second ring disposed about the rod, the second ring having an edge complementary to the bevelled first edge, such that longitudinal forces on the second ring are translated at least in part to radially directed forces on the split ring.

4. The pressure switch of claim 3 in which the split ring has a bevelled second edge on a side opposed to the bevelled first edge, the bevelled second edge tapering radially inward in a longitudinal direction away from the central portion of the split ring; and the pressure switch further including a third ring disposed about the rod on the side of the split ring opposed to the second ring, the third ring having an edge complementary to the bevelled second edge, such that longitudinal forces on the third ring are translated at least in part to radially directed forces on the split ring.

5. The pressure switch of claim 1 in which the means to increase frictional forces on the rod is disposed between the spring and a shoulder on the housing.

6. The pressure switch of claim 2 in which the split ring and the means to force the split ring radially inward are disposed between the spring and a shoulder on the housing.

7. The pressure switch of claim 3 in which the split ring and the second ring are disposed between the spring and a shoulder on the housing.

8. The pressure switch of claim 4 in which the split ring and the third ring are disposed between the spring and a shoulder on the housing.

* * * * *